US008378246B2

(12) United States Patent
Chu

(10) Patent No.: US 8,378,246 B2
(45) Date of Patent: Feb. 19, 2013

(54) ELECTRICALLY CONDUCTING STRUCTURE OF PRESS SWITCH

(76) Inventor: Ching-Hsiung Chu, Taipei (TW)

( * ) Notice: Subject to any disclaimer, the term of this patent is extended or adjusted under 35 U.S.C. 154(b) by 262 days.

(21) Appl. No.: 12/945,901

(22) Filed: Nov. 15, 2010

(65) Prior Publication Data

US 2012/0061228 A1 Mar. 15, 2012

(30) Foreign Application Priority Data

Sep. 9, 2010 (TW) ..... 99217476 U

(51) Int. Cl.
*H01H 13/14* (2006.01)

(52) U.S. Cl. ..... 200/520

(58) Field of Classification Search ..... 200/520, 200/531, 530, 314, 293, 332.1, 5 A
See application file for complete search history.

(56) References Cited

U.S. PATENT DOCUMENTS

| | | | | |
|---|---|---|---|---|
| 4,987,279 | A * | 1/1991 | Hirose et al. | 200/314 |
| 5,072,085 | A * | 12/1991 | Shinohara et al. | 200/314 |
| 5,278,362 | A * | 1/1994 | Ohashi | 200/5 A |
| 7,554,047 | B2 * | 6/2009 | Verdu et al. | 200/314 |
| 7,943,875 | B2 * | 5/2011 | Chu | 200/293 |
| 8,080,751 | B2 * | 12/2011 | Onuki et al. | 200/314 |

* cited by examiner

*Primary Examiner* — Edwin A. Leon

(57) ABSTRACT

An electrically conducting structure of a press switch includes a flexible flat cable connector provided in a base and connected to a circuit board supported on a movable seat. By pressing a housing of the electrically conducting structure, an electrically conducting element located in a bottom portion of the movable seat is brought into contact with electrically conducting terminals in the base to establish electrical conduction. As the flat cable of the flexible flat cable connector is flexible, it does not add to the load experienced by the user when pressing the housing.

12 Claims, 7 Drawing Sheets

ELECTRICALLY CONDUCTING STRUCTURE OF PRESS SWITCH

BACKGROUND OF THE INVENTION

1. Technical Field

The present invention relates to the electrically conducting structure of a press switch and, more particularly, to an improved electrically conducting structure for use inside a press switch.

2. Description of Related Art

A press switch is turned on (electrically conducted) or off (electrically insulated) by successive press, or more specifically via a back-and-forth moving mechanism. However, when subjected to the load and pressure of such back-and-forth motion fora long time, the resilient plates or terminals in the press switch may suffer from elastic fatigue or even break, thus resulting in poor electrical contact and significantly reducing the service life of the press switch. Moreover, should any one of the resilient plates or terminals be damaged, it is impossible to replace only the damaged parts, for the resilient plates or terminals are fixedly embedded in the press switch. As a result, the entire press switch will have to be discarded.

BRIEF SUMMARY OF THE INVENTION

The present invention provides an electrically conducting structure of a press switch. The electrically conducting structure includes a flexible flat cable connector which is provided in a base and connected to a circuit board supported on a movable seat. By pressing a housing of the electrically conducting structure, a supporting frame and the movable seat in the housing are moved downward. In consequence, an electrically conducting element provided in a bottom portion of the movable seat is brought into contact with electrically conducting terminals in the base to establish electrical conduction. As the flat cable of the flexible flat cable connector is flexible, it does not add to the load experienced by the user when pressing the housing.

BRIEF DESCRIPTION OF THE SEVERAL VIEWS OF THE DRAWINGS

A detailed description of further features and advantages of the present invention is given below with reference to the accompanying drawings, in which.

DETAILED DESCRIPTION OF THE INVENTION

Figure 1:
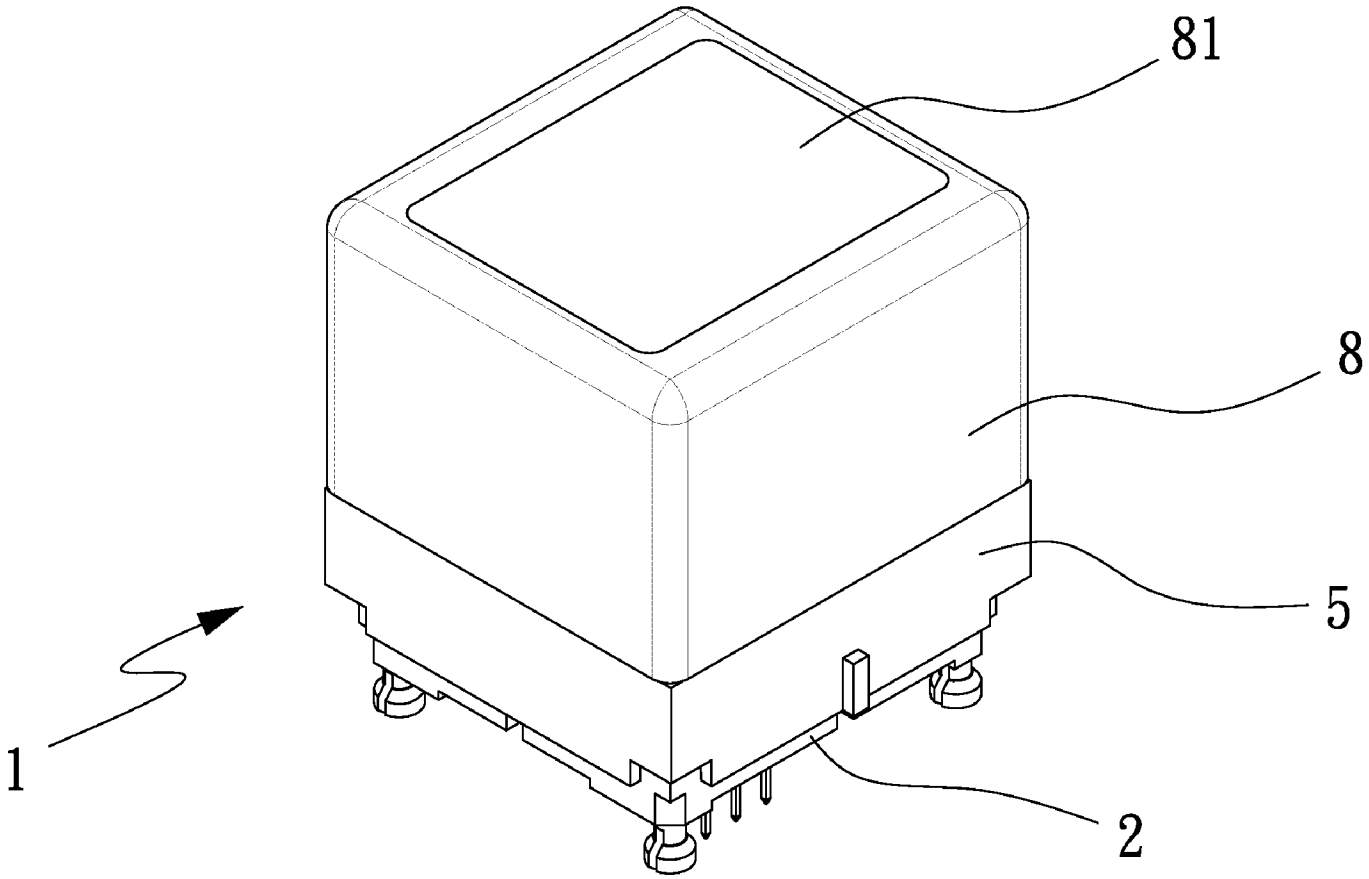
FIG. 1 is an assembled perspective view of the present invention.
Figure 2:
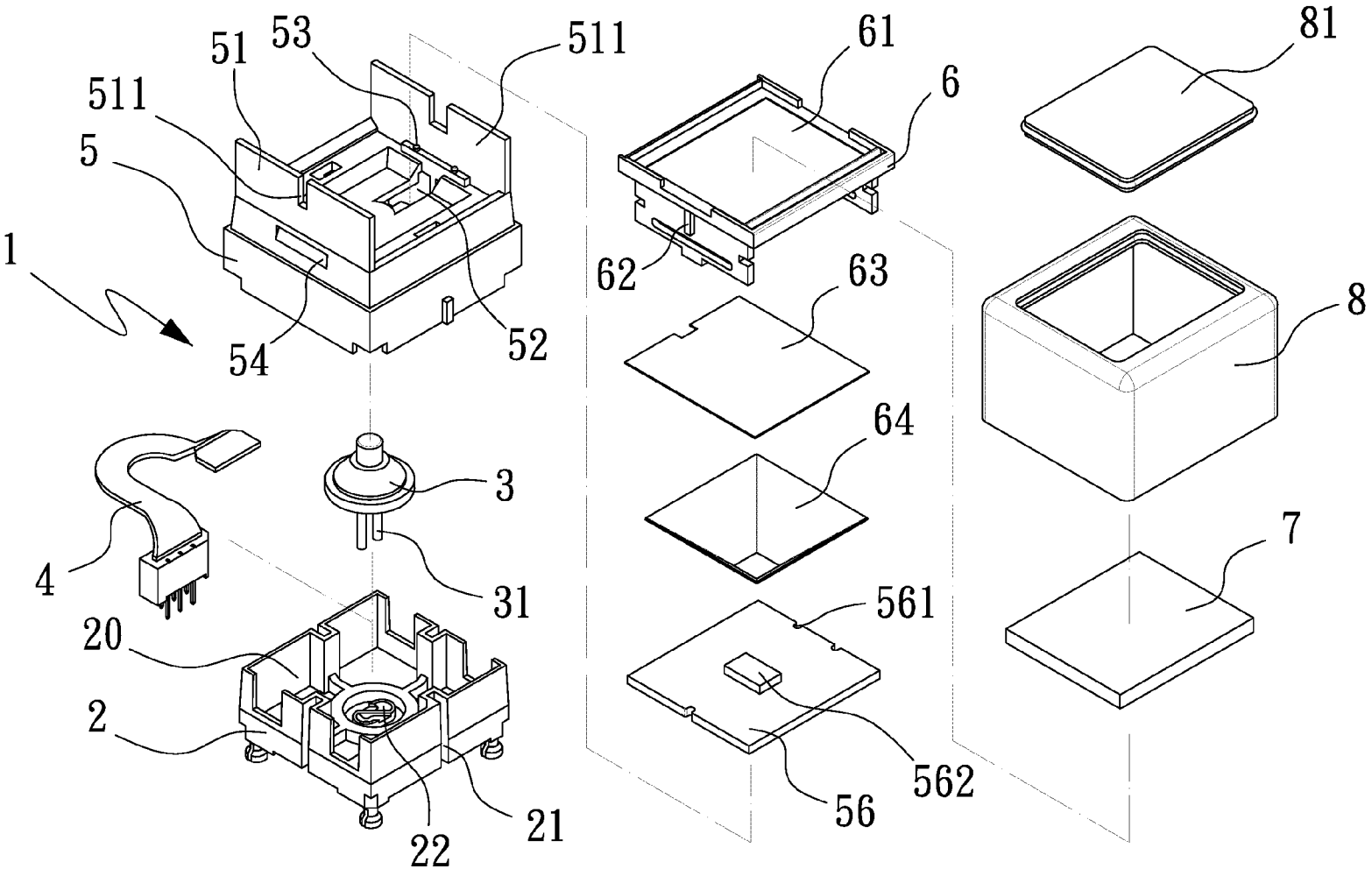
FIG. 2 is an exploded perspective view of the present invention.
Figure 3:
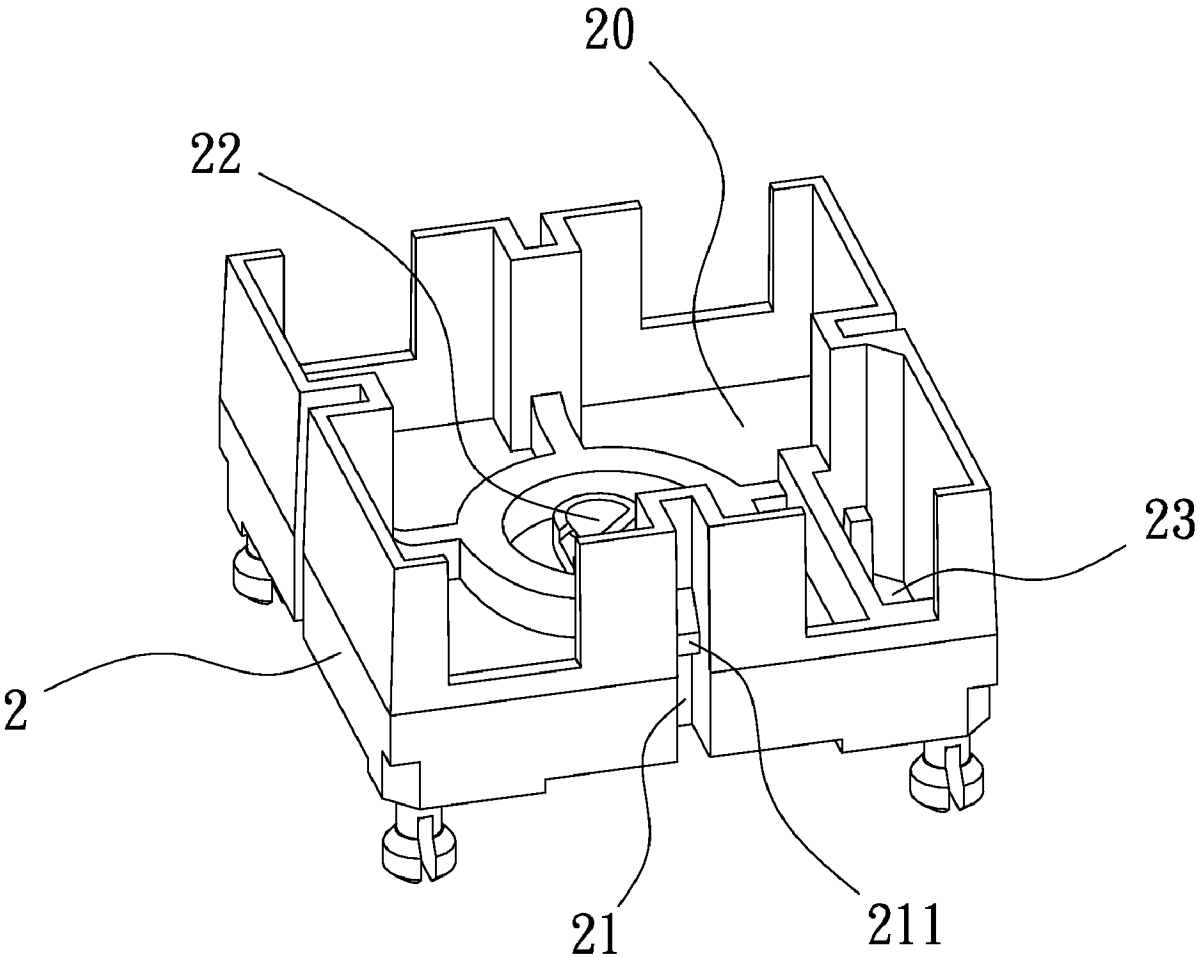
FIG. 3 is a partial perspective view of the present invention.
Figure 4:
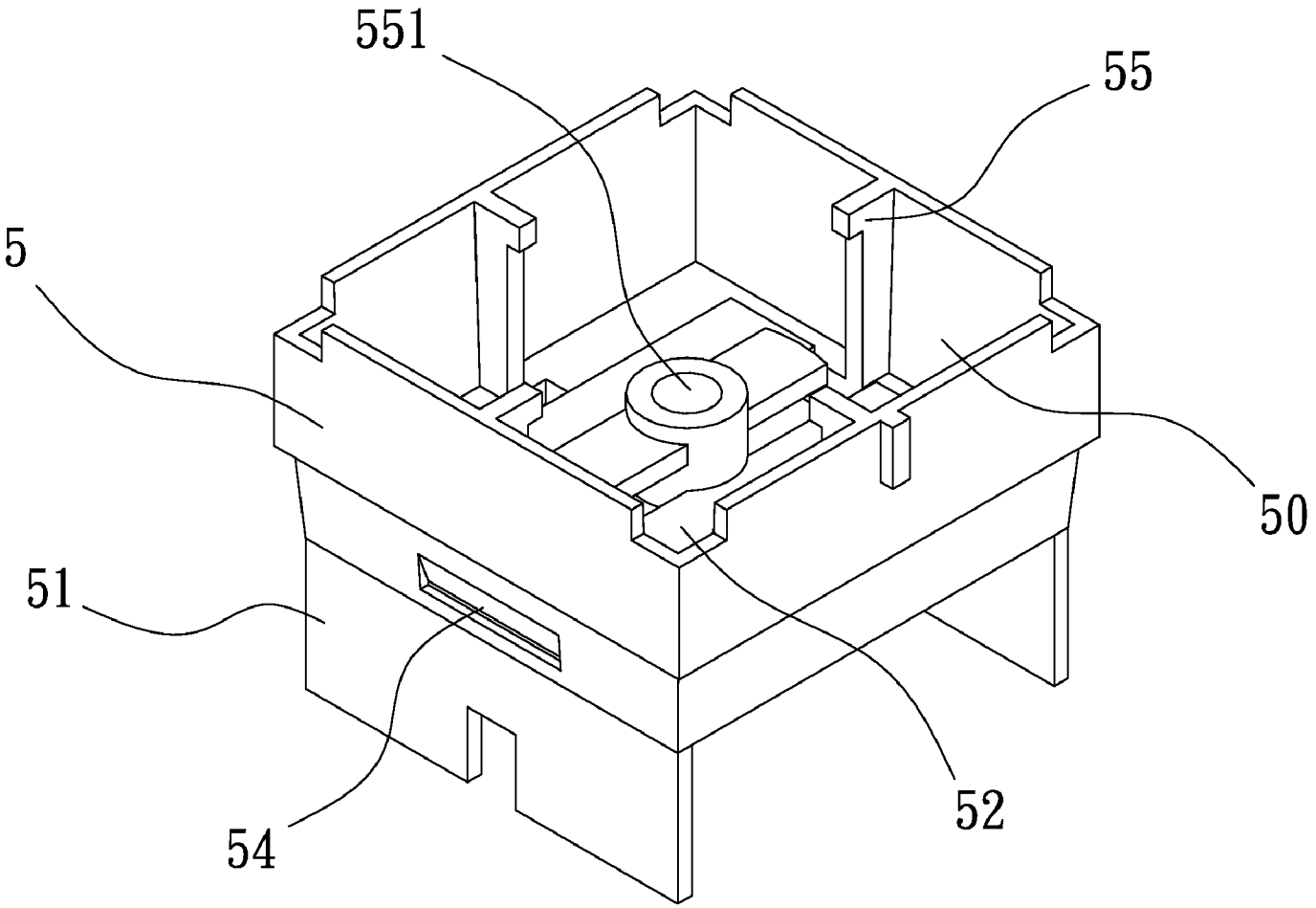
FIG. 4 is another partial perspective view of the present invention.
Figure 5:
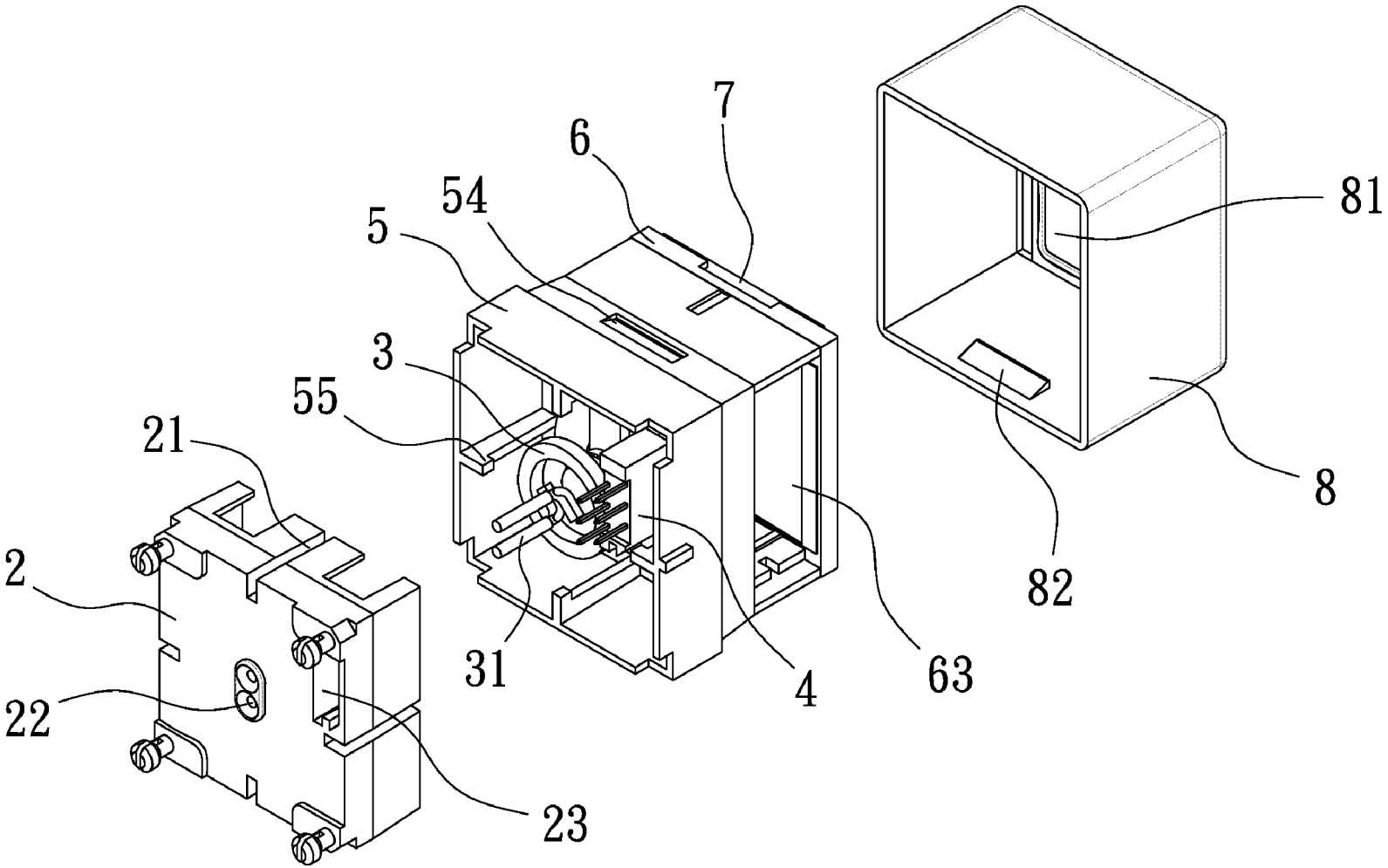
FIG. 5 is another exploded perspective view of the present invention.
Figure 6:
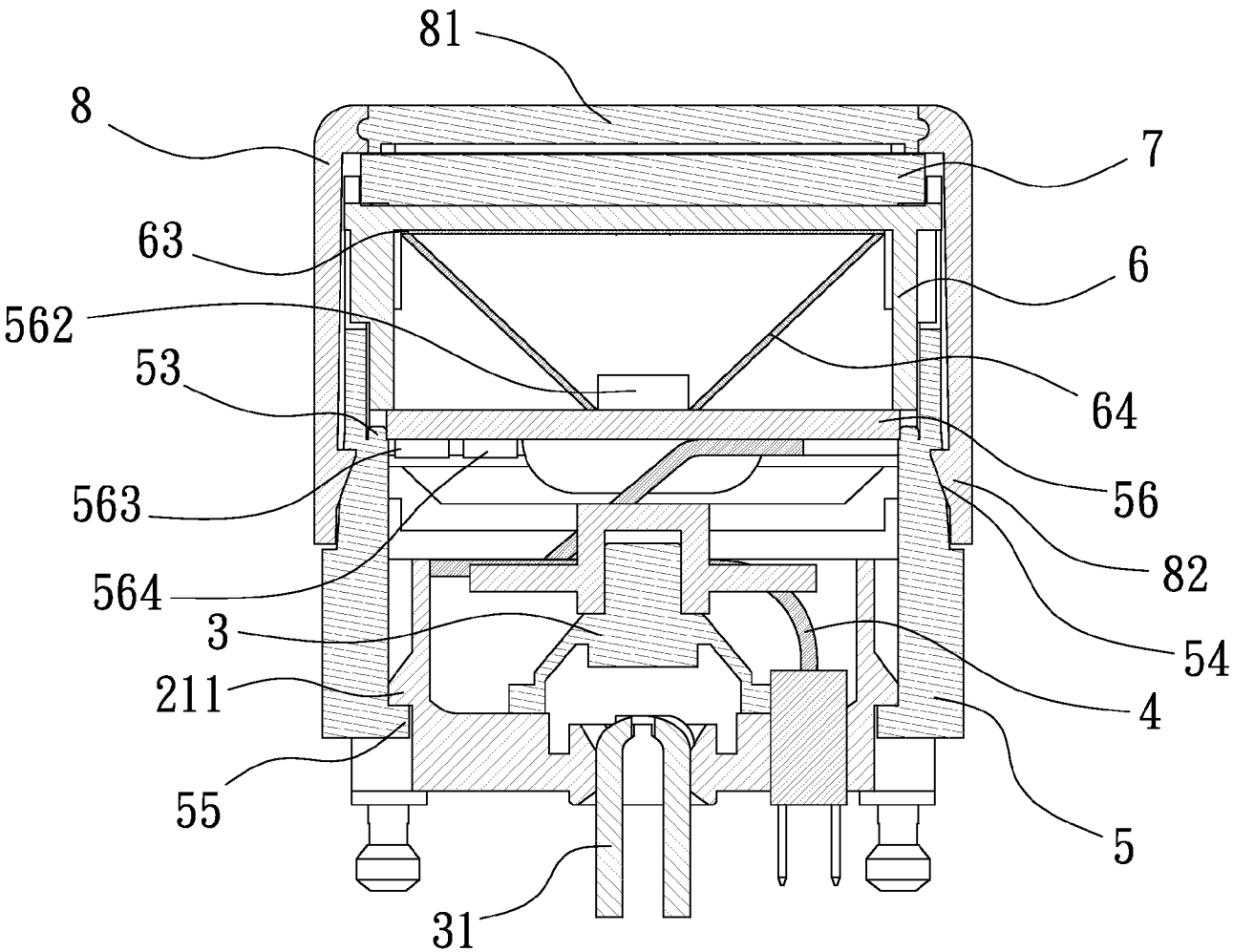
FIG. 6 is a sectional view of the present invention.
Figure 7:
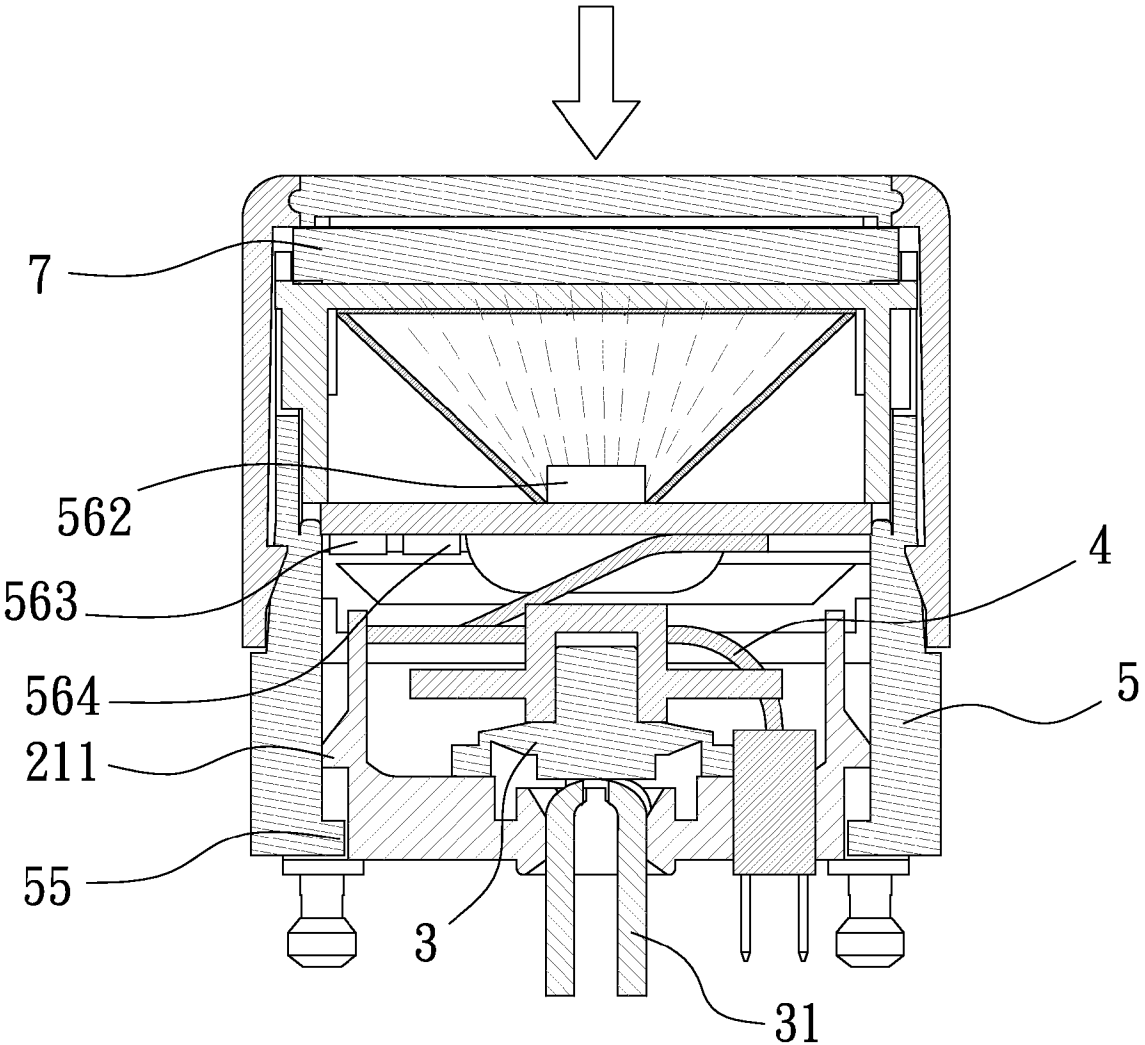
FIG. 7 is a sectional view showing the present invention in use.

Please refer to FIGS. 1 through 7 for an assembled perspective view, two exploded perspective views, two partial perspective views, and two sectional views of the present invention. As shown in the drawings, a press switch 1 has an electrically conducting structure that includes a base 2, a flexible flat cable connector 4, a movable seat 5, an electrically conducting element 3, a circuit board 56, a supporting frame 6, a light-converging element 64, a light-emitting diode (LED) screen 7, and a housing 8.

The base 2 defines a receiving space 20. Each of the four outer sides of the base 2 is formed with a guide groove 21, and each guide groove 21 is provided therein with a position-limiting block 211. Inside the receiving space 20 are two through holes 22 and an aperture 23. An electrically conducting terminal 31 is inserted in each through hole 22.

The flexible flat cable connector 4 is disposed in the aperture 23 of the base 2.

The movable seat 5 is provided on the base 2 and has a bottom portion defining a receiving space 50. The receiving space 50 has four inner walls, each formed with a ridge 55. The receiving space 50 is also provided with a positioning hole 551. Each of two opposite sides of the movable seat 5 is extended with a projecting wall 51. Each projecting wall 51 has a bottom edge provided with a plurality of positioning blocks 53. The movable seat 5 has a through hole 52 through which the flat cable of the flexible flat cable connector 4 can pass. In addition, each of two opposite outer sides of the movable seat 5 is formed with a slot 54. To install the movable seat 5 on the base 2, the ridges 55 are engaged respectively with the position-limiting blocks 211 in the guide grooves 21 formed on the exterior of the base 2, thereby connecting the movable seat 5 firmly to the base 2.

The electrically conducting element 3 is inserted in the positioning hole 551 in the bottom portion of the movable seat 5 and is therefore located on the bottom side of the movable seat 5.

The circuit board 56 is disposed on the movable seat 5, peripherally provided with a plurality of positioning holes 561, and mounted with a light-emitting element 562, wherein the light-emitting element 562 is a full-color LED. The flat cable of the flexible flat cable connector 4 is connected to one side of the circuit board 56. The circuit board 56 is installed on the movable seat 5 by engagement between the plural positioning holes 561 at the periphery of the circuit board 56 and the positioning blocks 53 of the movable seat 5.

The supporting frame 6 is provided on the movable seat 5 and forms a platform 61. Each of two opposite outer sides of the supporting frame 6 is provided with a projection 62. The projections 62 on the exterior of the supporting frame 6 are engaged respectively with the positioning holes 551 of the movable seat 5 to secure the supporting frame 6 to the movable seat 5.

The light-converging element 64 is placed on the circuit board 56 and provided with a light-diffusing plate 63.

The LED screen 7 is set on the platform 61 of the supporting frame 6.

The housing 8 covers the movable seat 5 and is embedded with a transparent cover 81. Each of two opposite inner walls of the housing 8 is formed with a protuberance 82. To install the housing 8 on the movable seat 5, the protuberances 82 on the inner walls of the housing 8 are engaged respectively with the slots 54 on two opposite outer sides of the movable seat 5 so that the housing 8 is securely connected to the movable seat 5.

Once the housing 8 is in place to cover the movable seat 5, the housing 8 is also connected to the movable seat 5. Therefore, when the housing 8 is pressed, the movable seat 5 is moved downward simultaneously and brings the electrically conducting element 3 into contact with the electrically conducting terminals 31 to establish electrical conduction. As the ridges 55 in the bottom portion of the movable seat 5 are confined in the guide grooves 21 of the base 2, the movable seat 5 is guided by the guide grooves 21 and moves smoothly when the housing 8 is pressed. On the other hand, the flat cable of the flexible flat cable connector 4 is inserted through the through hole 52 of the movable seat 5 and then connected to one side of the circuit board 56, which is set in the movable seat 5. Hence, both the light-emitting element 562 on the circuit board 56 and the LED screen 7 are powered via the flexible flat cable connector 4. Furthermore, due to the flexibility and the U-shaped design of the flat cable of the flexible flat cable connector 4, the back-and-forth (up/down) motion of the movable seat 5 will not be hindered by the flexible flat cable when the housing 8 is pressed, nor will the load of the pressing operation be increased.

Light emitted by the light-emitting element 562 is converged by the light-converging element 64 while the four working surfaces of the light-converging element 64 allow the light to be projected uniformly. The light is subsequently diffused by the light-diffusing plate 63, before being projected outward. Moreover, the circuit board is equipped with a memory element 564 and a microcontroller 563. The memory element 564 is configured for storing control programs, and the microcontroller 563 for controlling the emission of different color lights by the light-emitting element 562. The different color lights serve as background colors for the characters or symbols displayed by the LED screen 7.

As the electrically conducting terminals 31 and the flexible flat cable connector 4 are installed in the through holes 22 and the aperture 23 of the base 2 by way of insertion, it is possible to detach the electrically conducting terminals 31 and the flexible flat cable connector 4 from the base 2. Therefore, should the electrically conducting terminals 31 or the flexible flat cable connector 4 be damaged, the damaged element(s) can be directly removed from the base 2 for replacement and repair. Besides, the transparent cover 81 of the housing 8 is embedded in the housing 8 by insert molding, thus allowing the housing 8 to be free of gaps and effectively waterproof.

What is claimed is:

1. An electrically conducting structure of a press switch, comprising:

a base defining a receiving space therein and having four outer sides each formed with a guide groove, the receiving space being provided therein with electrically conducting terminals;

a flexible flat cable connector inserted in the receiving space of the base;

a movable seat provided on the base;

an electrically conducting element provided on a bottom side of the movable seat;

a circuit board provided on the movable seat;

a supporting frame provided on the movable seat;

a light-converging element provided above the circuit board;

a light-emitting diode (LED) screen provided on the supporting frame; and a housing covering the movable seat;

wherein the flexible flat cable connector is connected to the circuit board on the movable seat, and, when the housing is pressed, the supporting frame and the movable seat in the housing are moved downward to bring the electrically conducting element on the bottom side of the movable seat into contact with the electrically conducting terminals in the base, thereby establishing electrical conduction to the circuit board and the LED screen.

2. The electrically conducting structure of claim 1, wherein each said guide groove of the base is provided therein with a position-limiting block.

3. The electrically conducting structure of claim 1, wherein the receiving space of the base is provided with through holes in which the electrically conducting terminals are inserted respectively.

4. The electrically conducting structure of claim 1, wherein the movable seat is formed with a through hole through which the flexible flat cable connecter passes so as for an end of the flexible flat cable connector to be connected to the circuit board.

5. The electrically conducting structure of claim 1, wherein the movable seat has a bottom portion defining a second receiving space, the second receiving space having four inner walls each provided with a ridge.

6. The electrically conducting structure of claim 1, wherein the movable seat has opposite sides each extended with a projecting wall.

7. The electrically conducting structure of claim 1, wherein the movable seat has two opposite outer sides each formed with a slot.

8. The electrically conducting structure of claim 1, wherein the circuit board is provided with at least a light-emitting element, each said light-emitting element being a full-color LED.

9. The electrically conducting structure of claim 1, wherein the circuit board is provided with a microcontroller and a memory element.

10. The electrically conducting structure of claim 1, wherein the supporting frame forms a platform for supporting the LED screen.

11. The electrically conducting structure of claim 1, wherein the light-converging element is provided with a light-diffusing plate.

12. The electrically conducting structure of claim 1, wherein the housing is embedded with a transparent cover.

* * * * *